US005588777A

United States Patent [19]

Laak

[11] Patent Number: 5,588,777

[45] Date of Patent: Dec. 31, 1996

[54] WASTEWATER TREATMENT SYSTEM

[76] Inventor: Rein Laak, 149 Browns Rd., Storrs Mansfield, Conn. 06268-2808

[21] Appl. No.: 497,616

[22] Filed: Jun. 30, 1995

[51] Int. Cl.[6] ..... E02B 11/00

[52] U.S. Cl. ..... 405/40; 405/50

[58] Field of Search ..... 405/36, 40, 45, 405/46, 50, 53

[56] References Cited

U.S. PATENT DOCUMENTS 4,838,731 6/1989 Gavin ..... 405/40

*Primary Examiner*—William P. Neuder

*Attorney, Agent, or Firm*—McCormick, Paulding & Huber

[57] ABSTRACT

A wastewater treatment system provides a leaching field that may be of conventional configuration or may include certain unique features, the present invention relating to a subterranean horizontally oriented in-drain below the conventional leaching field that is adapted to be fed with a soapy solution to improve the biodegradation under anaerobic conditions heretofore possible only with wastewater treatment systems adapted to separate gray water from black water sewage.

5 Claims, 1 Drawing Sheet

WASTEWATER TREATMENT SYSTEM

CROSS REFERENCE TO RELATED APPLICATIONS

This application is related to a copending application entitled IMPROVED LEACHING FIELD AND METHOD OF MAKING filed Jun. 30, 1995 and identified by Ser. No. 497,220.

BACKGROUND OF THE INVENTION

The present invention relates to wastewater treatment systems, and deals more specifically with an improvement to a conventional septic tank system with a single holding tank, and associated leaching field, wherein the effluent from the leaching field is further processed in a porous bed that includes at least one horizontally disposed infiltration device, or in-drain, and wherein a liquid soap solution is periodically injected into this in-drain from a source at or above the level of the holding tank to take advantage of biological activity of the nitrates in this anaerobic atmosphere and thereby remove phosphors, viruses, bacteria and waste products in the system from the kitchen and laundry area. The liquid soap contains soluble organic carbon that serves as an anaerobic electron donor to denitrify the effluent nitrogen gas from such effluent.

Prior art sewage treatment systems of the type adapted to separate effluent, as between black water and gray water, are known. See for example my prior U.S. Pat. No. 4,465,594 issued Aug. 14, 1984 wherein the black water and gray water effluent are separated and fed to separate holding tanks. These effluents are then recombined in a denitrification process under anaerobic conditions.

SUMMARY OF THE INVENTION

It is a general purpose and object of the present invention to provide a wastewater treatment system that does not require separation of the wastewater as between the black water products from the kitchen and laundry area and the gray water from toilets, showers, bath water and the like.

In accordance with the present invention a wastewater treatment system is provided that comprises a conventional holding tank 10 having an inlet 12 for receiving the wastewater (both black water and gray water without separation) and that has an outlet 14 for discharging the effluent from this tank. A leaching field is provided for receiving this effluent from the tank outlet. A porous bed of sand or fine gravel 18 is provided below the leaching field and this bed includes at least one horizontally disposed in-drain provided in the porous bed. A source of liquid soap 28 is provided at the upper end of a conduit 24, the lower end of the conduit being coupled to the in-drain for injecting, preferably periodically, a liquid soap solution into the in-drain in order to enhance the biological activity of the nitrates reaching said in-drain in an anaerobic atmosphere as a result of the underground location for the in-drain.

BRIEF DESCRIPTION OF THE DRAWINGS

A more complete understanding of my invention and many of the attendant advantages thereto will be readily appreciated as the same becomes better understood by reference to the following detailed description when considered in conjunction with the accompanying drawings wherein.

DETAILED DESCRIPTION

Figure 1:
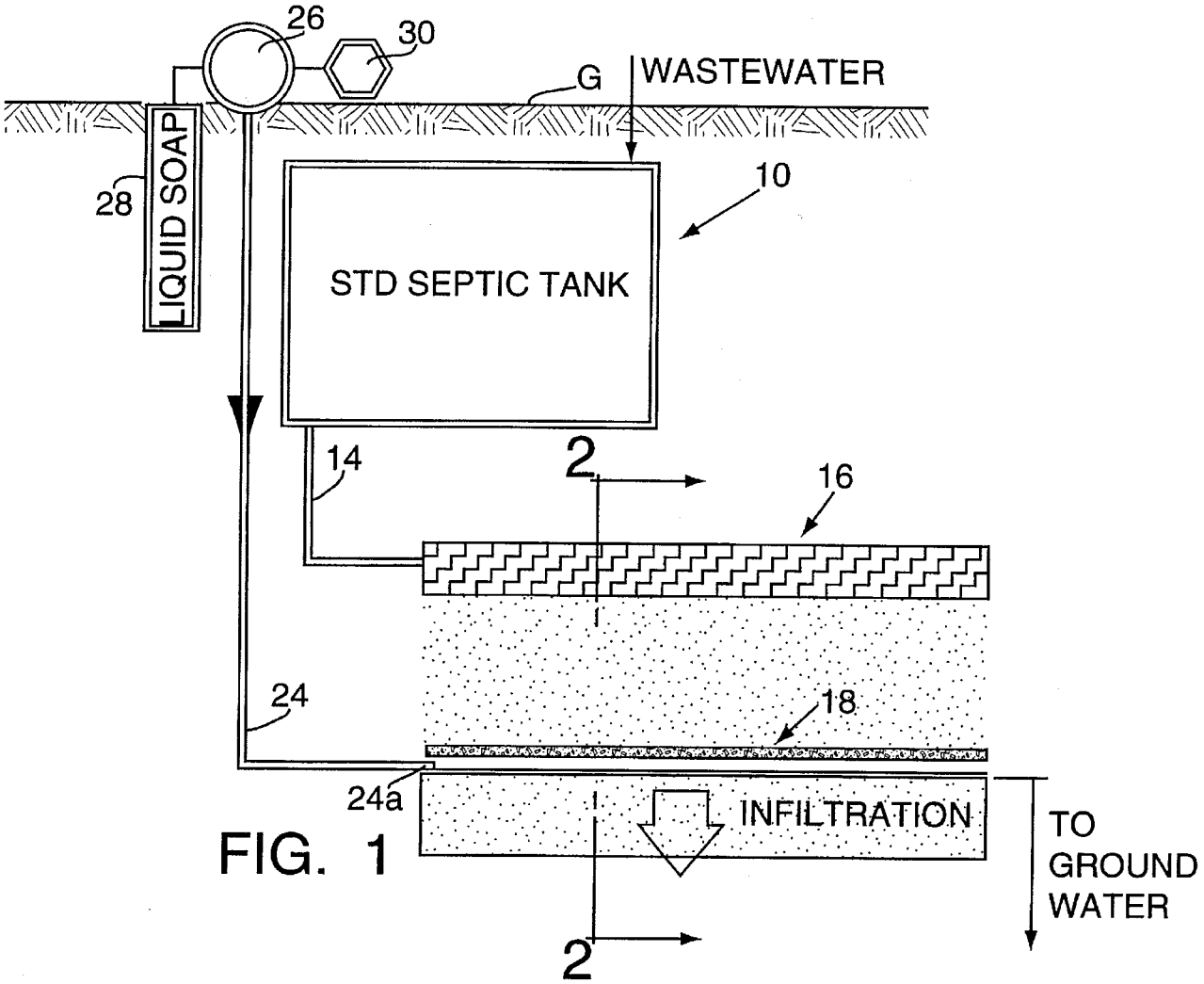
FIG. 1 is a schematic representation of the present invention in a schematic vertical section.

Turning now to the drawings in greater detail, FIG. 1 shows a conventional holding tank 10 having an inlet 12 for receiving wastewater as suggested generally by the arrow adjacent the top of the holding tank. The ground level is indicated generally at G to illustrate schematically the subterranean location for the conventional septic or holding tanks. The holding tank 10 has an outlet through which the effluent is adapted to pass through conduit 14 into a leaching field 16 which may be of conventional configuration downstream of the holding tank 10. The leaching field 16 is shown immediately below the holding tank but such is not required nor desirable in most situations as long as the leaching field is physically at a level below that of the septic tank itself.

The leaching field 16 may comprise a conventional series of parallel trenches that are in turn filled with crushed stone, and that are fed effluent from the holding tank through a distribution pipe (not shown) which may comprise a perforated pipe located in or above these trenches. Such a leaching field is generally provided in an excavation and is later filled to some predetermined depth below the surface of the ground. Such depth below ground level may be only a matter of a few inches or a foot, and the schematic level of the ground G in FIG. 1 is intended to represent the ground level relative only to the septic tank itself. Alternatively the leaching field may be similar to that described in the copending application identified above.

Figure 2:
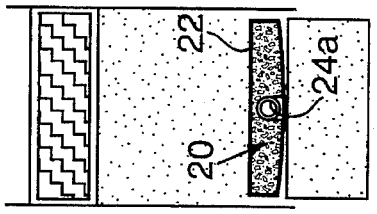
FIG. 2 is a sectional view taken generally on the line 2—2 of FIG. 1 again illustrating in schematic fashion the leaching field together with the subadjacent porous bed and associated horizontally disposed in-drain.

Immediately below the leaching field 16, whether that field be of conventional construction or of a construction as taught in my copending application, a bed of sand is provided to a depth of approximately three feet below the leaching field to receive the effluent filtered by the leaching field. This three foot deep porous bed, provided in the form of sand layers, has an intermediate layer which consists of a horizontally disposed in-drain 18 provided two feet below the leaching field and provided with at least one foot of sand below such in-drain. The in-drain may comprise a core such as that shown in FIG. 2 at 20, which core is surrounded by a fabric envelope of geotextile nonwoven material. The outer envelope of geotextile fabric material is indicated generally at 22 and is wrapped around the lower branch **24*a* of the conduit means indicated generally at 24. This lower branch 24*a* is arranged horizontally and received in the in-drain envelope. Note that FIG. 2 shows this conduit branch 24*a* as extending virtually the entire length of the horizontally disposed in-drain 18**.

The upper end of the conduit means 24 communicates with a pump 26 that draws liquid soap from a reservoir 28 in response to the output of a timer 30 so as to periodically inject liquid soap into the conduit means 24 and hence into the in-drain itself to enhance the biological activity of the nitrates reaching said in-drain in what amounts to an anaerobic atmosphere defined below the surface of the ground G. Finally, and as mentioned previously, a one foot bed of sand is preferably provided below the in-drain so that the output from the in-drain is relatively pure water and easily dispersed into the underlying soil.

Obviously many modifications and variations of the present invention will become apparent in light of the above teaching. For example, the leaching field 16 may be of conventional construction or may instead embody the invention described and claimed in my above-identified copending application. Further, and in place of the metering pump and timer described previously, the homeowner might instead simply operate the input to conduit means 24 manually by means of a conventional valve, holding the valve open for a limited period of time once a day or once a week to inject a desired amount of liquid soap solution into the in-drain.

In light of the above, it is therefore understood that within the scope of the appended claims, the invention may be practiced otherwise and as specially described.

What is claimed is:

1. A subterranean wastewater treatment system that receives wastewater containing both nitrates and other waste products and comprising in combination;

a holding tank having an inlet for receiving the wastewater and settling out the waste products so that a liquid effluent with nitrates included therein is provided in the holding tank, and said holding tank further including an outlet for discharging the effluent from said holding tank, a leaching field to provide an anaerobic atmosphere for receiving the effluent from said tank outlet, a porous bed below said field, said bed including at least one horizontally disposed in-drain provided in said porous bed, and conduit means coupled to said in-drain for injecting a liquid soap into said in-drain to enhance biological activity of the nitrates in the effluent reaching said in-drain in an anaerobic atmosphere.

2. The system of claim 1 wherein said horizontally disposed in-drain comprises an outer envelope of nonwoven geotextile fabric, and an inner core sheet or expanded cross sections surrounded by said outer envelope.

3. The system of claim 2 wherein said conduit means has an upper end located at or above said holding tank inlet, a liquid soap reservoir, a metering pump, and a timer, said timer providing periodic injections of liquid soap into said conduit means.

4. The system according to claim 2 wherein said conduit means has a lower end coupled to said in-drain, said lower end of said conduit means provided in said envelope of said in-drain.

5. The combination according to claim 4 wherein said conduit means has an upper end located at or above said holding tank inlet, a liquid soap reservoir, a metering pump, and a timer, said timer providing periodic injections of liquid soap into said conduit means.

* * * * *